United States Patent [19]

Swift et al.

[11] Patent Number: 4,516,632

[45] Date of Patent: May 14, 1985

[54] MICROCHANNEL CROSSFLOW FLUID HEAT EXCHANGER AND METHOD FOR ITS FABRICATION

[75] Inventors: Gregory W. Swift, Los Alamos; Albert Migliori, Santa Fe; John C. Wheatley, Los Alamos, all of N. Mex.

[73] Assignee: The United States of America as represented by the United States Deparment of Energy, Washington, D.C.

[21] Appl. No.: 413,635

[22] Filed: Aug. 31, 1982

[51] Int. Cl.[3] ..... F28F 3/00; F28F 3/08

[52] U.S. Cl. ..... 165/167; 165/166

[58] Field of Search ..... 165/166, 167

[56] References Cited

U.S. PATENT DOCUMENTS

| | | | |
|---|---|---|---|
| 1,662,870 | 3/1928 | Stancliffe | 165/166 |
| 3,228,465 | 1/1966 | Vadot | 165/166 |
| 3,231,017 | 1/1966 | Henderson | 165/166 |
| 3,823,457 | 7/1974 | Staas et al. | 165/167 |
| 4,434,845 | 3/1984 | Steeb | 165/166 |

FOREIGN PATENT DOCUMENTS

| | | | |
|---|---|---|---|
| 1569499 | 6/1980 | United Kingdom | 165/166 |

*Primary Examiner*—William R. Cline
*Assistant Examiner*—John K. Ford
*Attorney, Agent, or Firm*—William A. Eklund; Paul D. Gaetjens; Judson R. Hightower

[57] ABSTRACT

A microchannel crossflow fluid heat exchanger and a method for its fabrication are disclosed. The heat exchanger is formed from a stack of thin metal sheets which are bonded together. The stack consists of alternating slotted and unslotted sheets. Each of the slotted sheets includes multiple parallel slots which form fluid flow channels when sandwiched between the unslotted sheets. Successive slotted sheets in the stack are rotated ninety degrees with respect to one another so as to form two sets of orthogonally extending fluid flow channels which are arranged in a crossflow configuration. The heat exchanger has a high surface to volume ratio, a small dead volume, a high heat transfer coefficient, and is suitable for use with fluids under high pressures. The heat exchanger has particular application in a Stirling engine that utilizes a liquid as the working substance.

3 Claims, 9 Drawing Figures

MICROCHANNEL CROSSFLOW FLUID HEAT EXCHANGER AND METHOD FOR ITS FABRICATION

This invention is the result of a contract with the Department of Energy (Contract No. W-7405-ENG-36).

BACKGROUND OF THE INVENTION

The invention disclosed herein is generally related to heat exchangers. More particularly, the present invention is directed to a heat exchanger suitable for use in a Stirling engine having a liquid as the working fluid.

In a Stirling engine there is a working fluid, typically a gas, which is passed through a cyclical sequence of steps in the course of converting heat to work. In one step of the Stirling cycle, the gas is compressed and passed through a heat exchanger to be cooled. In another step of the cycle the gas is expanded and passed through a second heat exchanger to be heated.

The applicants have sought to develop a Stirling engine in which the working fluid is a liquid. In such an engine the compression and expansion stages of the Stirling cycle involve much higher pressure changes and much smaller volume changes than occur in a gas-based engine. A heat exchanger suitable for such a liquid-based Stirling engine must meet several requirements. First, the total volume of fluid entrained in the heat exchanger should be small, i.e., the heat exchanger should have a small "dead volume". Secondly, the heat exchanger must have a high heat transfer coefficient. Further, the heat exchanger should have a low fluid flow impedance and a correspondingly low rate of viscous heat dissipation. Finally, the heat exchanger must be capable of accommodating liquids at variable pressures as high as several thousand pounds per square inch (psi).

SUMMARY OF THE INVENTION

Accordingly, it is the object and purpose of the present invention to provide a compact, efficient heat exchanger for conducting heat from one fluid to another fluid.

It is also an object of the present invention to provide a heat exchanger for use where one or both of the fluids may be at a pressure as high as several thousand psi.

It is another object of the invention to provide a heat exchanger that has a high heat transfer coefficient, and in which the volume of entrained fluid is small.

It is also an object to provide a heat exchanger that attains the foregoing objects, and which has a low fluid flow impedance.

It is also an object to provide a method of making a heat exchanger having the characteristics set forth above.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention as embodied and broadly described herein, the heat exchanger of the present invention comprises a stack of thin metal sheets which are bonded together to form an integral unit. The stack is made up of alternating slotted and unslotted sheets. Each of the slotted sheets includes multiple parallel slots which pass through the sheet and which form fluid flow channels when the slotted sheet is sandwiched between adjacent unslotted sheets. Successive slotted sheets in the stack are oriented with their slots extending in orthogonal directions so as to form two sets of fluid flow channels arranged in a crossflow configuration. The stack further includes suitable manifold means whereby one fluid can be passed through the channels formed by the slots extending in one direction, and another fluid can be passed through the channels formed by the slots extending in the other direction. By using thin sheets and narrow, closely spaced slots it is possible to obtain several thousand densely packed fluid flow channels in a heat exchanger having a maximum dimension of only a few inches. The large number of channels in such a compact heat exchanger results in a high ratio of surface area to volume of entrained fluid, as well as a small total volume of entrained fluid. Further, the solid metal construction results in a high heat transfer coefficient and also renders the heat exchanger suitable for use where one or both fluids are at pressures of up to several thousand pounds per square inch.

The present invention is also directed to the particular method of making the heat exchanger, comprising the steps of stacking the suitably formed slotted and unslotted sheets in the arrangement described above, and bonding the stacked sheets together to form an integral unit.

In the preferred embodiment, the heat exchanger is formed of stainless steel sheets which are bonded together with copper by furnace brazing in a hydrogen atmosphere. The slots in the sheets are preferably formed by chemical milling so as to result in fluid flow channels of uniform cross-sectional dimension and thereby also resulting in uniform fluid flow impedance. Additionally, by appropriate layout during the chemical etching step it is possible to provide internal manifold channels which simplify fabrication and facilitate installation of the heat exchanger.

These and other advantages and aspects of the present invention will be more readily apparent from the following detailed description of the preferred embodiment, taken with the accompanying drawings.

BRIEF DESCRIPTION OF THE DRAWINGS

The accompanying drawings, which are incorporated in and form a part of the specification, illustrate the preferred embodiment of the present invention and, together with the description, serve to explain the principles of the invention. In the drawings.

DETAILED DESCRIPTION OF THE PREFERRED EMBODIMENT

FIGS. 1 through 4 illustrate a first preferred embodiment of the heat exchanger of the present invention. FIG. 5 shows the initial step in the assembly of the preferred embodiment, as further described below.

Figure 3:
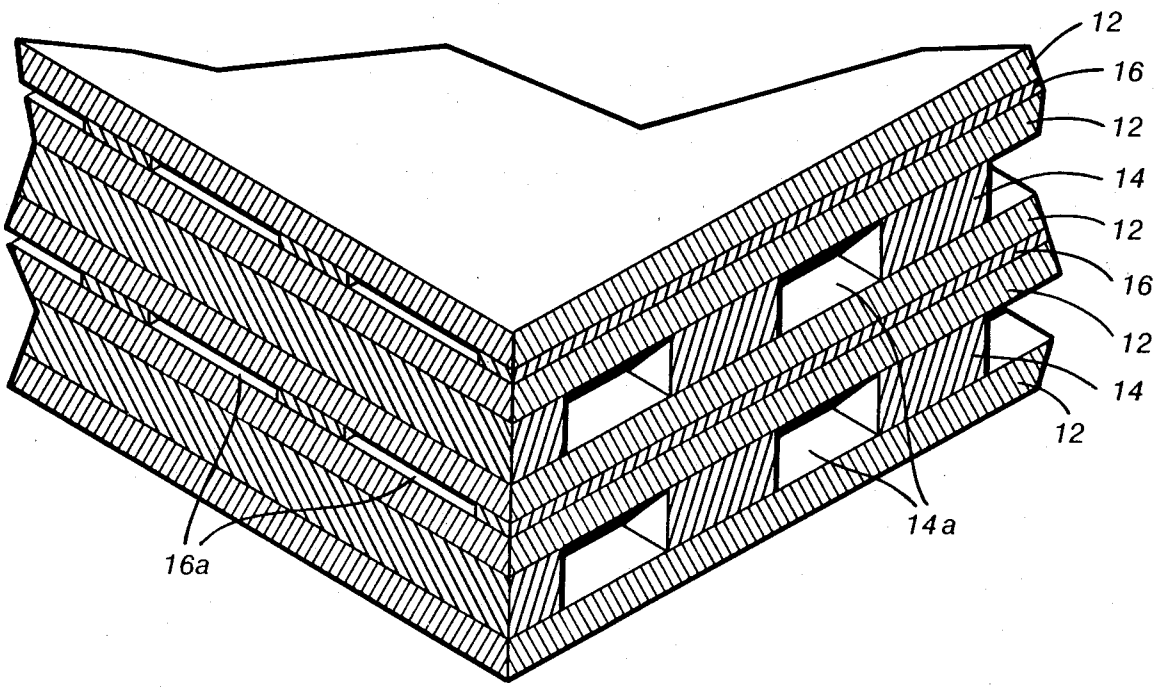
FIG. 3 is an enlarged isometric view showing the internal structure of the heat exchanger in cross-section.

Referring first to FIG. 5, the heat exchanger is formed from a stack 10 of 600 square stainless steel sheets. There are three types of sheets, designated 12, 14 and 16, which are arranged in a repeating sequence as shown in FIGS. 3 and 5. Sheets 12 are unslotted and comprise every other sheet in the stack, for a total of 300 unslotted sheets 12. The sheets 14 and 16 are provided with multiple parallel slots 14*a* and 16*a*, respectively. All of the slots 14*a* of sheets 14 extend in one direction, and all of the slots 16*a* are oriented orthogonally to the slots 14*a*.

There is a total of 150 each of the slotted sheets 14 and 16. As shown in FIG. 5, there is a slotted sheet between each pair of unslotted sheets 12, and the slotted sheets 14 and 16 are ordered in a regular alternating sequence throughout the heat exchanger. Additionally, there is a solid end plate 17 of relatively greater thickness at the bottom of the stack, and a similar end plate at the top of the stack (not shown).

The thicknesses of the three types of sheets 12, 14 and 16 are 0.005, 0.008 and 0.002 inch, respectively. The slots 14*a* in sheets 14 are 0.016 inch wide and 0.016 inch apart. The slots 16*a* in sheets 16 are 0.020 inch wide and 0.010 inch apart. The slots are preferably formed by appropriate masking and chemical milling of unperforated stainless steel sheets.

Figure 4:
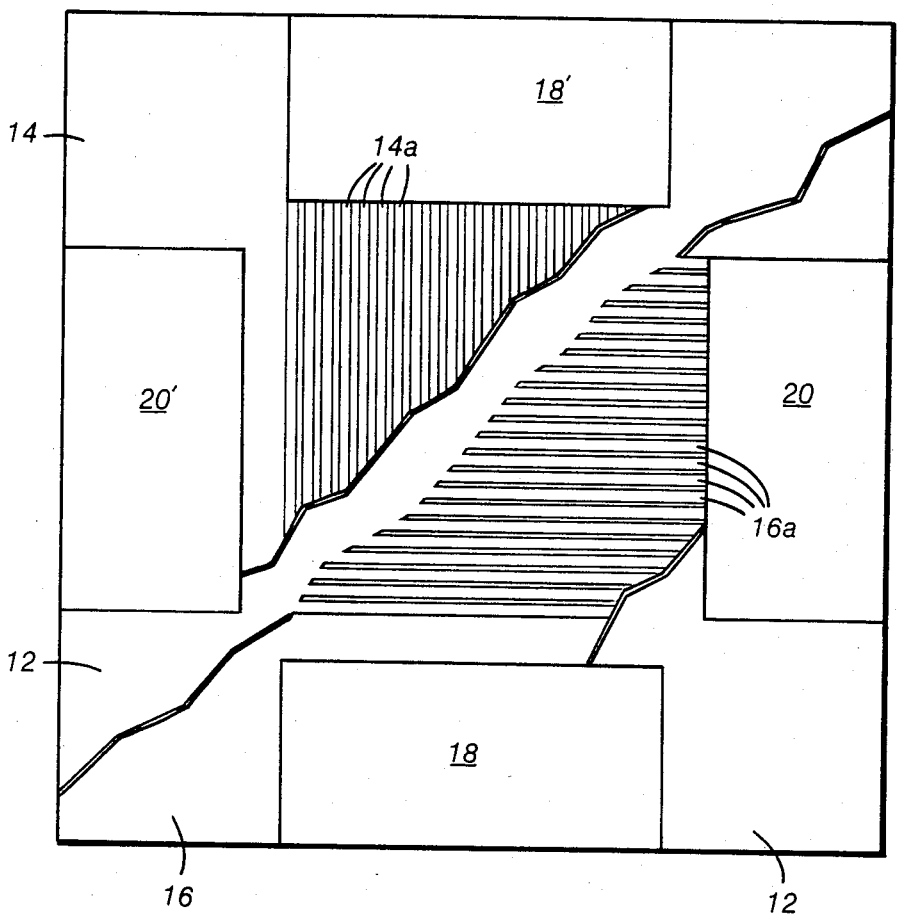
FIG. 4 is a plan view in cross-section of the heat exchanger, taken along section line 4—4 of FIG. 2, and with portions of the uppermost several sheets broken away for purposes of illustration.
Figure 5:
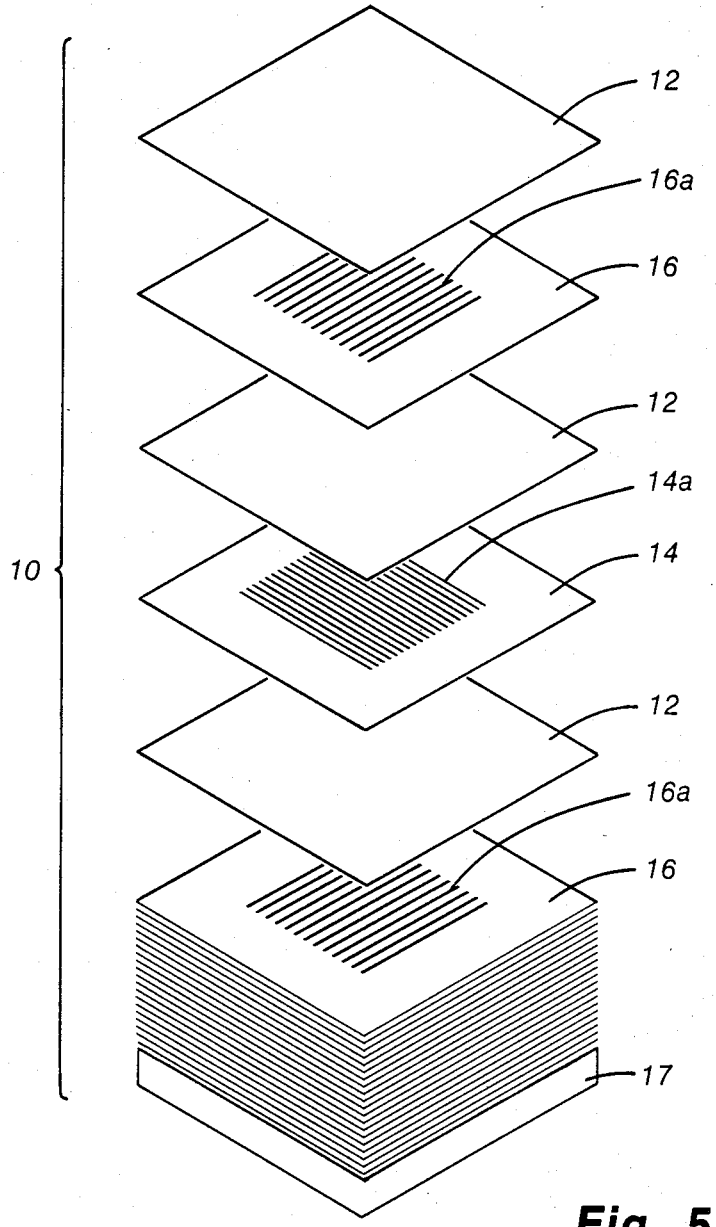
FIG. 5 is an exploded isometric view showing how the individual sheets of the heat exchanger are stacked in the initial stage of fabrication.
Figure 6:
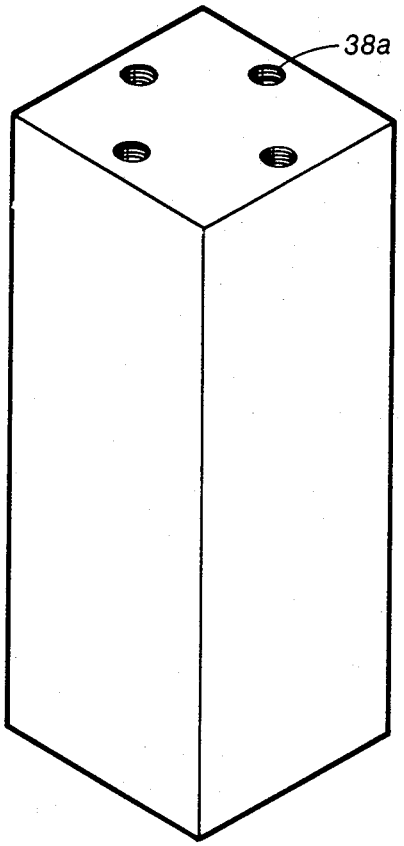
FIG. 6 is an isometric pictorial view of a second preferred embodiment of the invention.

As shown in FIGS. 4 and 5, the multiple slots in sheets 14 and 16 extend over central zones of the sheets which are rectangular in shape. These rectangular zones are longest in the directions parallel to the slots, such that when the sheets are stacked the rectangular slotted zones cross one another. This results in the ends of slots 14*a* extending beyond the outermost slots 16*a* of sheets 16; and the ends of slots 16*a* likewise extending beyond the outermost slots 14*a* of the sheets 14. This enables the ends of the slots 14*a* and 16*a* to be accessed by milling recesses into the sides of the bonded stack of sheets, as described further below.

Copper is the preferred bonding agent for the stainless steel sheets. The copper is applied to both sides of the unslotted sheets 12 to a thickness of 1.4 μm by vacuum deposition. The sheets are then stacked as shown in FIG. 5 and subsequently bonded by furnace brazing the stack in a hydrogen atmosphere at approximately 2020° F. The stack is compressed under a pressure of approximately 20 psi during brazing. Tests of heat exchangers constructed in this manner have shown that the tensile strength of the bonds between the sheets is on the order of 60,000 psi.

Figure 1:
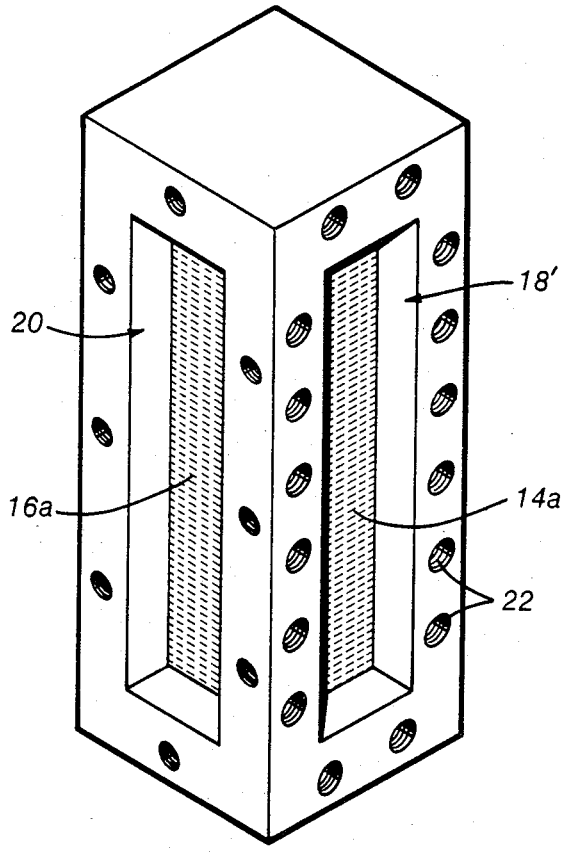
FIG. 1 is a full scale isometric view of a first preferred embodiment of the heat exchanger of the present invention, with the apparent sizes of the fluid flow channels (slots 14*a* and 16*a*) exaggerated for purposes of illustration.
Figure 2:
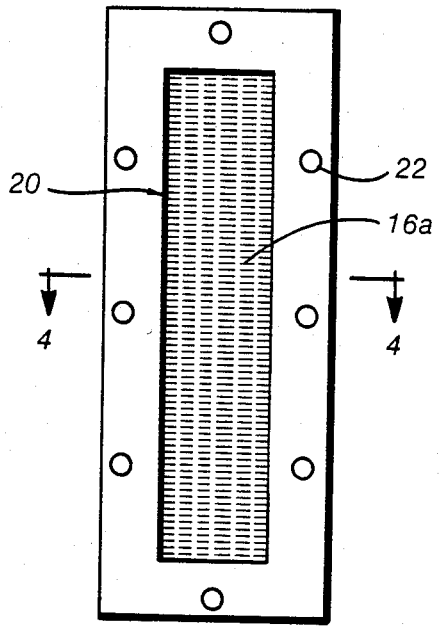
FIG. 2 is a side elevation view of the heat exchanger of FIG. 1.

The brazed stack of sheets is milled on all four sides to form opposing pairs of rectangular manifold recesses 18 and 18′, and 20 and 20′, shown in FIGS. 1, 2 and 4. The recesses 18 and 18′ open onto the exposed opposite ends of the slots 14*a*, and the recesses 20 and 20′ open onto the ends of slots 16*a*. Electrical discharge milling is employed in the final stages of milling to prevent formation of burrs around the slot openings. The milled recesses form manifolds by which fluids can be admitted to and received from the channels formed by the slots 14*a* and 16*a*. Threaded bores 22 are formed in the brazed stack around the manifold recesses to permit attachment of suitable flanges to seal the fluid.

It should be noted that the sizes of the slots 14*a* and 16*a*, as viewed end-on in FIGS. 1 and 2, are greatly exaggerated for purposes of illustration. In the actual embodiment the slots are so small when viewed end-on as to be barely perceptible to the unaided eye, there being approximately 3,000 slots opening onto each of the recesses milled in the sides of the heat exchanger. Nevertheless, the cross-sectional slot density is sufficiently high that light is readily transmitted through the heat exchanger in the direction of the slots.

It will be seen, particularly in FIGS. 3 and 4, that the heat exchanger is exceptionally compact. The illustrated heat exchanger is designed for use with water flowing through the 0.008×0.005″ channels (slots 14*a*) at 200 $cm^3$/sec and liquid propylene flowing through the 0.020×0.002″ channels (slots 16*a*) at 100 $cm^3$/sec, at pressures up to 2000 psi. The viscous power dissipation under such conditions is estimated to be approximately 1.0 watt for both the propylene and the water. The volume of propylene entrained in the exchanger is 1.6 $cm^3$. The total volume of the heat exchanger, excluding end walls and flanges, is 30 $cm^3$. The heat transfer coefficient of the exchanger is 450 W/° C.

One advantage of the heat exchanger is that the fluid flow channels have nearly uniform flow impedance. In this regard, the flow impedance (Z) of one channel is represented by the equation:

$$Z=(12\ L)/wd^3$$

where L is the length of a rectangular channel, w is the width of the channel, and d is its height. Since the impedance varies inversely with $d^3$, it is important to minimize variations in the dimension d. This is accomplished in the present invention by forming the crossflow channels by chemical milling, and by utilizing stainless steel sheets of controlled thickness.

FIGS. 6–9 illustrate a second embodiment of the invention, in which the fluid manifolds are built internally into the heat exchanger during the chemical etching step of fabrication. The heat exchanger consists of a stack 30 of thin metal sheets which are bonded together under pressure in essentially the same manner as described above with respect to the first embodiment. Like the heat exchanger described above, the heat exchanger of FIGS. 6–9 consists of alternating slotted sheets 32 and unslotted, or unperforated sheets 34. All of the slotted sheets 32 of this embodiment are substantially identical to one another, but successive slotted sheets in the stack are rotated by 90° with respect to one another in an alternating sequence in the same manner as the slotted sheets of the first embodiment described above.

Figure 7:
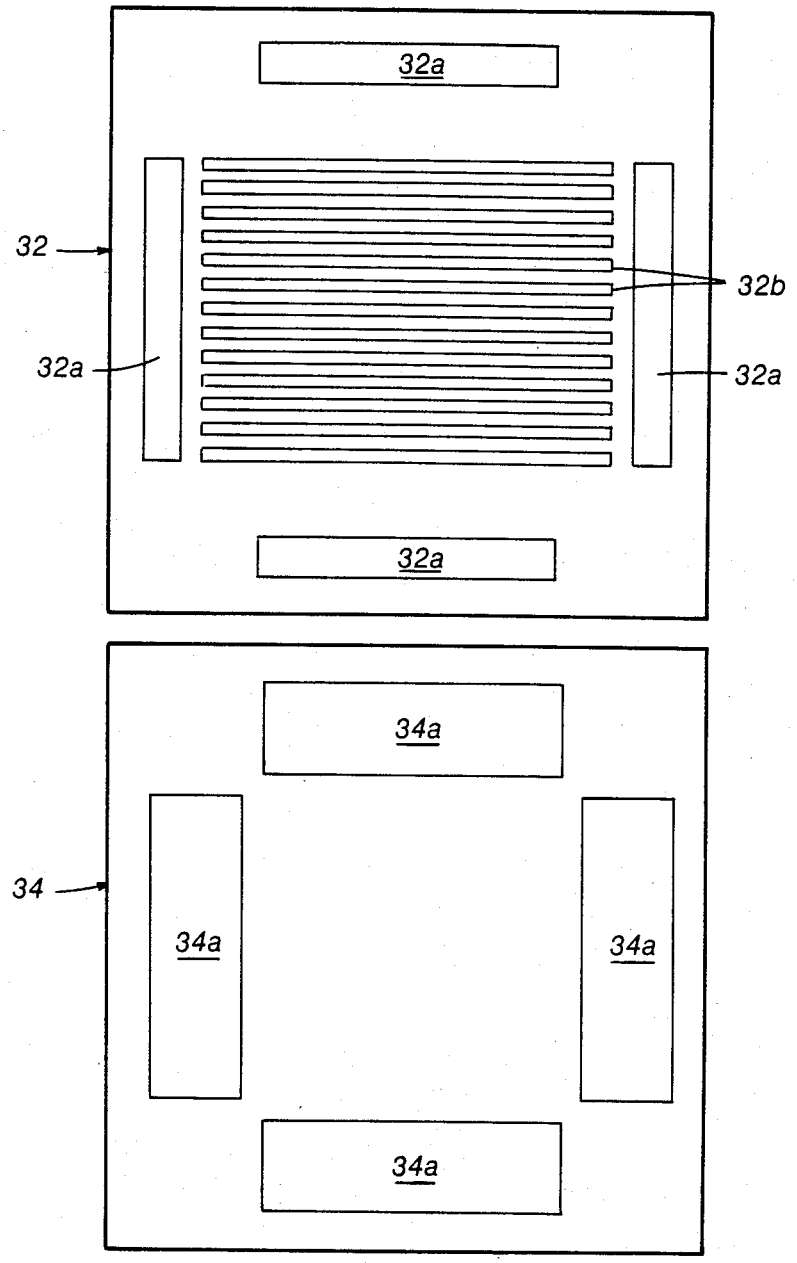
FIG. 7 is a plan view of the two types of sheets used to construct the heat exchanger of FIG. 6.
Figure 8:
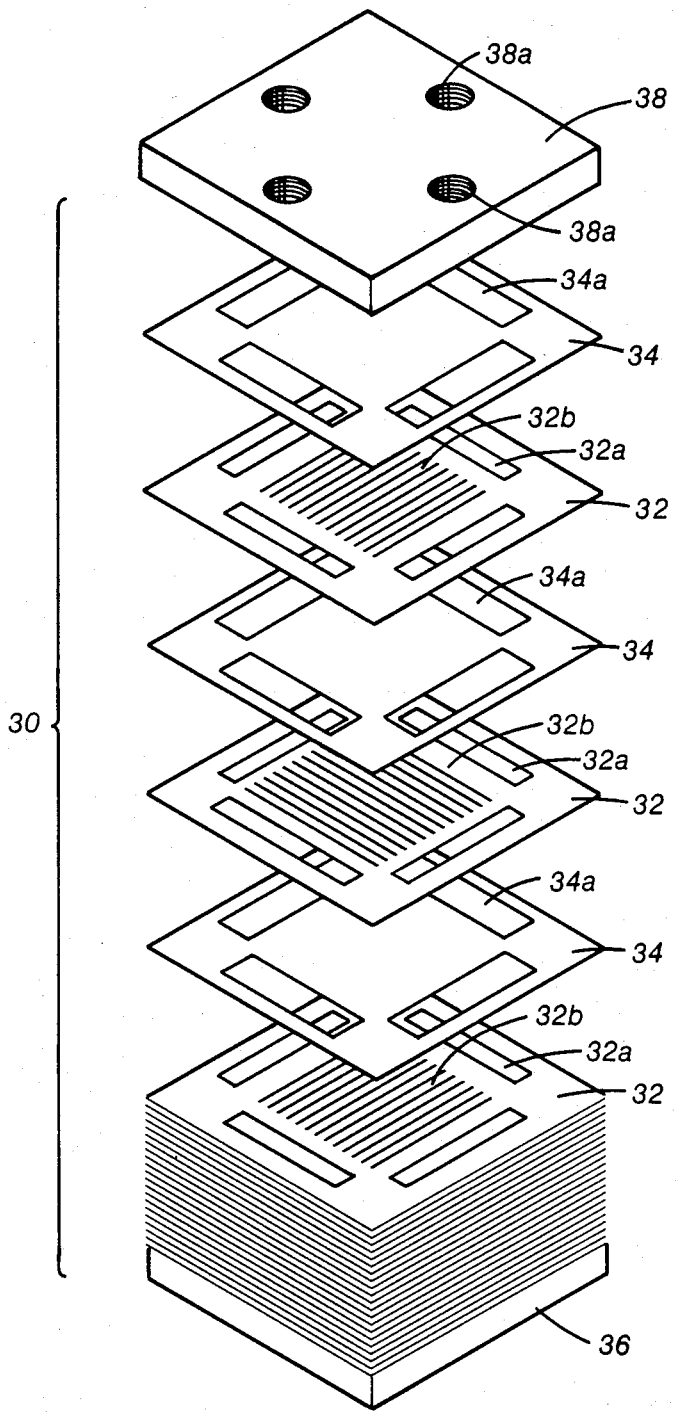
FIG. 8 is an exploded isometric view of the heat exchanger of FIG. 6, with the number of sheets substantially reduced for purposes of illustration.

Referring particularly to FIGS. 7 and 8, each of the unslotted sheets 34 of the second embodiment is provided with a set of four rectangular manifold openings 34*a*, which are centered on and extend alongside the four edges of the square sheet. Similarly, each of the slotted sheets 32 is provided with four rectangular manifold openings 32*a*. When the slotted and unslotted sheets are stacked as shown in FIG. 8, the manifold openings 34*a* and 32*a* are aligned with one another to form four internal manifold channels which extend the full length of the heat exchanger. Additionally, the manifold openings 34*a* of the unslotted sheets 34 are wider than the manifold openings 32*a* of the slotted sheets 32, such that the manifold openings 34*a* overlap the ends of the slots 32*b* in the slotted sheets 32. In this manner, all of the slots 32*b* extending in one direction within the heat exchanger are placed in fluid communication with the pair of manifold channels formed by the manifold openings 34*a* and 32*a* adjacent the opposite ends of such slots, and all of the slots extending in the other direction are connected to the other pair of internal manifold channels.

The heat exchanger further includes a solid end plate 36 at the bottom of the stack 30, and a solid top plate 38 which is provided with four fluid access holes 38*a* by which fluid may be admitted to and received from the internal fluid manifolds.

Figure 9:
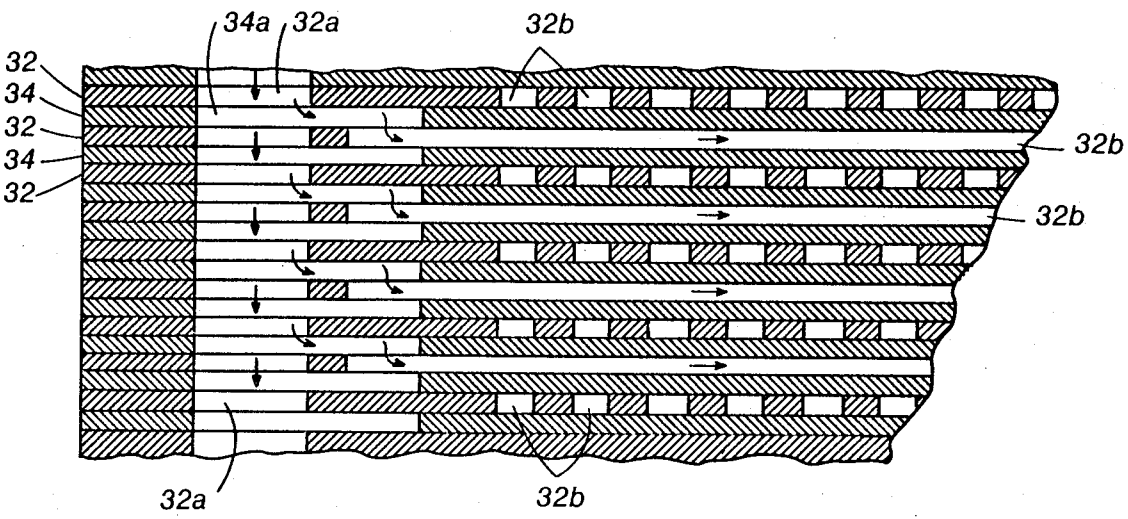
FIG. 9 is an enlarged partial side view in cross-section of the heat exchanger of FIG. 6.

Operation of the heat exchanger is shown in the cross-sectional view of FIG. 9. Fluid is pumped down one of the fluid access holes 38*a* and passes downwardly through the fluid manifold channel defined by the manifold openings 32*a* and 34*a*, from which the fluid enters the transverse slots 32*b*. It will be recognized that, like the heat exchanger described above, the heat exchanger of FIGS. 6–9 is characterized by its high fluid channel density, high surface to volume ratio, and small dead volume. Additionally, the second embodiment is easier to construct because no milling of the assembled and bonded stack of sheets is required.

The foregoing description of two preferred embodiments of the invention has been presented for purposes of illustration and description. It is not intended to be exhaustive or to limit the invention to the precise forms disclosed, and obviously many modifications and variations are possible in light of the above teaching. The two embodiments of the invention described above have been presented in order to best explain the principles of the invention and its practical application and to thereby enable others skilled in the art to best utilize the invention in various embodiments and with various modifications as are suited to the particular use contemplated. Although the invention is disclosed as having particular application as a heat exchanger for a liquid-based Stirling engine, the invention is in no way limited to such application and may be utilized in any application for which it is found useful. It is intended that the scope of the invention be defined by the claims appended hereto.

What is claimed is:

1. A crossflow fluid heat exchanger comprising a stack of thin metal sheets brazed together so as to be bonded by integral metal-to-metal bonds, said stack including alternating slotted and unslotted sheets, each of said slotted sheets having a plurality of parallel slots formed therein which extend over rectangular central regions of said sheets and which form fluid flow channels when sandwiched between said unslotted sheets, successive slotted sheets in the stack being oriented with their slots extending substantially orthogonally so as to form two sets of fluid flow channels arranged in a crossflow configuration, each of said unslotted sheets including a set of four rectangular manifold openings positioned adjacent the peripheral edges of said unslotted sheet, and wherein each of said slotted sheets includes a set of four rectangular manifold openings adjacent the peripheral edges of said slotted sheet, the manifold openings in said unslotted sheets being wider than the manifold openings in said slotted sheets so as to overlap the ends of the slots in said slotted sheets, whereby said manifold openings of said unslotted sheets and said manifold openings of said slotted sheets are aligned to form internal fluid flow manifolds connecting the opposite ends of the two orthogonal sets of fluid flow channels.

2. The heat exchanger defined in claim 1 wherein said sheets are formed of stainless steel and are bonded together with copper.

3. The heat exchanger defined in claim 2 wherein said sheets are bonded together with layers of copper approximately 1.4 μm thick.

* * * * *